US010284995B2

(12) United States Patent
Brännmark et al.

(10) Patent No.: US 10,284,995 B2
(45) Date of Patent: May 7, 2019

(54) REDUCING THE PHASE DIFFERENCE BETWEEN AUDIO CHANNELS AT MULTIPLE SPATIAL POSITIONS

(71) Applicant: DIRAC RESEARCH AB, Uppsala (SE)

(72) Inventors: Lars-Johan Brännmark, Uppsala (SE); Jakob Ågren, Uppsala (SE)

(73) Assignee: DIRAC RESEARCH AB, Uppsala (SE)

( * ) Notice: Subject to any disclaimer, the term of this patent is extended or adjusted under 35 U.S.C. 154(b) by 0 days.

(21) Appl. No.: 15/769,526

(22) PCT Filed: Oct. 30, 2015

(86) PCT No.: PCT/SE2015/051146

§ 371 (c)(1),
(2) Date: Apr. 19, 2018

(87) PCT Pub. No.: WO2017/074232

PCT Pub. Date: May 4, 2017

(65) Prior Publication Data

US 2018/0317037 A1 Nov. 1, 2018

(51) Int. Cl.
*H04S 1/00* (2006.01)
*H04S 7/00* (2006.01)

(52) U.S. Cl.
CPC ..... *H04S 7/303* (2013.01); *H04S 1/00* (2013.01); *H04S 1/002* (2013.01); *H04R 2499/13* (2013.01)

(58) Field of Classification Search
CPC ..... H01R 3/00; H01R 2499/13; H01R 3/04; H01R 3/14; H01R 5/033; H01R 1/1008;
(Continued)

(56) References Cited

U.S. PATENT DOCUMENTS 5,046,097 A * 9/1991 Lowe ..... H04S 1/002 381/17
5,208,860 A * 5/1993 Lowe ..... H04S 1/002 381/17

(Continued)

OTHER PUBLICATIONS

Michael J. Smithers: "Improved Stereo Imaging in Automobiles", Audio Engineering Society, Convention Paper 7223, resented at the 123rd Convention Oct. 5-8, 2007 New York, NY, USA.*
Jens Blauert: "The Psychophysics of Human Sound Localization" Spatial Hearing, The MIT Press Cambridge, Massachusetts.
Brett Crockett et al.: "Next Generation Automotive Research and Technologies", Audio Engineering Society, Convention Paper 6649, Presented at the 120th Convention May 20-23, 2006 Paris, France.

(Continued)

*Primary Examiner* — Lun-See Lao
(74) *Attorney, Agent, or Firm* — Young & Thompson

(57) ABSTRACT

There is provided a method and corresponding system for determining phase adjustment filters for an associated sound generating system including at least two audio reproduction channels $C_1$ and $C_2$ where each of the audio reproduction channels $C_1$ and $C_2$ has an input signal and at least one loudspeaker located in a listening environment. The method includes estimating, for each of the audio reproduction channels $C_1$ and $C_2$, an acoustic transfer function at each of $M \geq 1$ spatial positions in the listening environment, based on sound measurements at the spatial positions; and determining, based on the acoustic transfer functions, phase adjustment filters $F_1$ and to be applied, respectively, to the audio reproduction channels $C_1$ and $C_2$, to reduce the inter-loudspeaker differential phase, IDP, between the audio reproduction channels $C_1$ and $C_2$ in p listener positions.

20 Claims, 19 Drawing Sheets

(58) Field of Classification Search
CPC ..... H01R 1/227; H01R 1/26; H01R 1/403; H01R 29/001; H01R 5/02; H01R 1/1075; H01R 2201/023; H01R 2205/022; H01R 2400/11; H01R 2420/07; H01R 2499/11; H01R 5/04; G10L 13/02; G10L 15/26; G10L 21/0272; G10L 15/02; G10L 15/14; G10L 2015/025; G10L 25/18; G10L 19/173; G10L 19/005; G10L 21/0202; H04S 1/002; H04S 1/00; H04S 7/303; H04S 5/00; H04S 7/30; H04S 2400/01; H04S 2420/01; H04S 2400/11; H04S 2420/03; H04S 3/002; H04S 5/005; H04S 7/301; H04S 7/305; H04S 1/005; H04S 3/00; H04S 3/02; H04S 7/302; H04S 7/40; H04B 1/088; H04J 3/042; H04R 5/04
USPC ..... 381/303, 1, 17, 63, 97
See application file for complete search history.

(56) References Cited

U.S. PATENT DOCUMENTS

| | | | | |
|---|---|---|---|---|
| 8,116,458 | B2 * | 2/2012 | Mizuno | H04S 7/302 381/18 |
| 8,798,274 | B2 * | 8/2014 | Sakai | H04S 7/301 381/17 |
| 2009/0304213 | A1 * | 12/2009 | Cook | H04S 1/002 381/300 |
| 2010/0054483 | A1 | 3/2010 | Mizuno et al. | |
| 2011/0150241 | A1 * | 6/2011 | Christoph | H04S 7/301 381/103 |
| 2012/0224701 | A1 | 9/2012 | Sakai et al. | |

OTHER PUBLICATIONS

Michael J. Smithers: "Improved Stereo Imaging in Automobiles", Audio Engineering Society, Convention Paper 7223, Presented at the 123rd Convention Oct. 5-8, 2007 New York, NY, USA.
International Search Report, dated Sep. 9, 2016, from corresponding PCT/SE2015/051146 application.

* cited by examiner

REDUCING THE PHASE DIFFERENCE BETWEEN AUDIO CHANNELS AT MULTIPLE SPATIAL POSITIONS

TECHNICAL FIELD OF THE INVENTION

The present invention generally concerns digital filters for audio reproduction and more particularly phase shifting filters, whose aim are to reduce a frequency-dependent phase difference between two audio channels.

BACKGROUND OF THE INVENTION

Stereo Reproduction and the Near-Side Bias Problem

Multichannel audio recordings, and in particular recordings in 2-channel stereo, rely to a great extent on the principle of summing localization [1] to be correctly perceived when played back over a pair of loudspeakers. In order for the summing localization principle to work as intended, it is required that the listener is located between two identical loudspeakers, with equal distance d to both loudspeakers, as illustrated in FIG. 1.

Such a symmetrical arrangement of loudspeakers and listener makes it possible for the listener to experience a stereo panorama, or sound image, when a stereo recording is played back through the loudspeakers (that is, when the left and right channels of the recording are played back through the left and right loudspeakers, respectively). Various components of the stereo signal are then perceived as sound sources located somewhere between the loudspeakers. In particular, a mono signal, which is equal in left and right channels, will be perceived as coming from a point in the center, straight in front of the listener. This is the so-called phantom center effect.

If the listener is not positioned along the center axis between the loudspeakers, as in FIG. 1, but is closer to one of the loudspeakers, then the stereo panorama will be incorrectly perceived. For example, if the listener's distance $d_1$ to the left loudspeaker is shorter than the distance $d_2$ to the right loudspeaker, then the sound from the left loudspeaker arrives at the listener with a shorter time delay than the sound from the right loudspeaker. Due to the resulting time difference between the left and right loudspeakers, the perceived direction of sound will be heavily biased towards the left loudspeaker, see FIG. 2. In particular, the mono component of the stereo signal will in such a scenario no longer be perceived as coming from straight ahead of the listener, but almost solely from the left speaker. This collapse of the stereo panorama into the loudspeaker closest to the listener is often referred to as near-side bias. The most common and well known example of near-side bias occurs when listening to stereo recordings in an automobile, where the listener is situated either to the left or to the right of the center axis. A schematic view of the automobile example is shown in FIG. 3, where Listener 1 sits closer to the left loudspeaker, and Listener 2 sits closer to the right loudspeaker. Thus, in the example of FIG. 3, a sound that is intended to be reproduced as coming from a point straight ahead of the listener will be experienced by Listener 1 as corning from the left side, and by Listener 2 as coming from the right side.

The delay difference between two channels of an audio system, experienced at a spatial position, can be described in the frequency domain by a phase difference function, commonly referred to as inter-loudspeaker differential phase (IDP), taking values between −180 and +180 degrees [5], an example of which is shown in FIG. 5. The IDP allows for a more general description of the time difference between channels, in the sense that it can accommodate for time delays that are frequency dependent.

The IDP between two audio channels $C_1$ and $C_2$ can be determined either by using information from a single point in space, or by using information from a pair of points in space. In the first case, the IDP is obtained by comparing the acoustic transfer function of channel $C_1$ with that of channel $C_2$ at the same point. In the latter case, the IDP is obtained by comparing the transfer function of channel $C_1$ in one point with the transfer function of channel $C_2$ at another point. A listener position, for which the IDP between two channels $C_1$ and $C_2$ is defined, can thus be associated with either one single point or a pair of points in space.

In an ideal, theoretically constructed version of the automobile example, one assumes that the two loudspeakers and the listening environment are perfectly symmetrical, and that two listeners are positioned symmetrically on each side of the center axis, as illustrated in FIG. 4, where the left listener is a distance $|d_1-d_2|$ closer to the left loudspeaker than to the right loudspeaker, and vice versa for the right listener. The delay difference between the loudspeaker channels experienced by the two listeners can then be described in the frequency domain by two IDP functions, as illustrated in FIG. 5. In the particular example shown in FIG. 5, the loudspeaker and listener positions were such that $|d_1-d_2|=35.6$ cm. It can be seen in FIG. 5 that the IDP functions in this case either increase or decrease linearly with frequency, depending on which side of the center axis the listener is situated (the black line is the phase difference at the left listener position and the grey line is the IDP at the right listener position). It should be noted that IDP functions, such as those in for example FIG. 5, may be considered to be continuous even if they appear to contain discontinuous jumps of 360 degrees at some frequencies. This is because of the ambiguity in how phase angles are represented: an angle of +190 degrees is equivalent to an angle of −170 degrees, an angle of 360 degrees is equivalent to an angle of 0 degrees, and so on. It thus makes sense to describe an IDP or a phase curve as for example linearly increasing even if it decreases by a discontinuous jump of 360 degrees at some frequencies.

It can further be seen in FIG. 5 that the frequency axis can be divided into sequential frequency bands where both listeners experience either an IDP within the interval of ±90 degrees, or an IDP of more than ±90 degrees. In particular, there are frequencies (0 Hz, 966 Hz, 1932 Hz, etc.) where the IDP is zero at both listener positions. This happens when the distance difference $|d_1-d_2|$ corresponds to an integer multiple of the acoustic wavelength, so that a mono signal at that frequency, emitted by both loudspeakers, will yield a maximally constructive interference at both listener positions. Similarly, there are frequencies (483 Hz, 1449 Hz, 2415 Hz, etc.) where the distance difference $|d_1-d_2|$ corresponds to an odd number of half wavelengths, in which case a mono signal will yield a maximally destructive interference at both listener positions.

At frequencies where the IDP at both listener positions is limited to between ±90 degrees, the system is said to be predominantly in-phase, and at frequencies where both IDPs are outside of the interval ±90 degrees, the system is said to be predominantly out-of-phase.

The presence of sequential in-phase and out-of-phase frequency bands described above adds an undesired spectral distortion (so-called comb filtering) to the reproduced sound which, together with the near-side bias problem, significantly deteriorates the listening experience.

Possible Remedies to Near-Side Bias

In the case of one single listener located somewhere off from the center axis, the near-side bias problem can be corrected to a great extent if a delay is added to the signal path of the loudspeaker closest to the listener, so that the left and right signals arrive at the listener with equal delay, similarly to the situation when the listener is located on the center axis between the loudspeakers.

However, if there are two or more listeners, and the listeners are located at separate spatial positions, then adding a delay to one channel cannot resolve the near-side bias problem for all listeners. For example, if one listener is closer to the left loudspeaker and another listener is located closer to the right loudspeaker (as in FIG. 4), then a delay in the left channel will solve the near-side bias problem for the left listener, but the right listener will experience an even worse bias to the right side.

A previously proposed solution to the near-side bias problem is based on viewing the delay differences as phase difference functions, often referred to as inter-loudspeaker differential phase (IDP) functions, in the frequency domain, as described in the previous section. The idea is then to use phase shifting filters which add a phase difference of 180 degrees to the channels, thereby changing the IDP by 180 degrees, in one or several of those frequency bands where the system is predominantly out-of-phase [2, 3, 4, 5]. The adding of a phase difference of 180 degrees to the channels can be accomplished in many different ways; for example by applying a filter that shifts the phase 180 degrees in the left channel and leaving the right channel unprocessed. Alternatively, one can add +90 degrees to one channel and −90 degrees to the other, as suggested in for example [2]. The phase responses of such filters are shown in FIG. 6, where the black line is the desired phase response of the left channel filter, and the grey line is the desired phase response for the right channel filter. For a symmetrical situation such as in FIG. 4, the IDP functions that result from applying such filters to the system are shown in FIG. 7, where the black line is the IDP at the left listener position and the grey line is the IDP at the right listener position. Comparing FIG. 5 and FIG. 7, one can observe that the system has changed from alternating between predominantly in-phase and out-of-phase in sequential frequency bands, to being predominantly in-phase for all frequencies. Since the processed system is now predominantly in-phase everywhere, the comb filtering effect is alleviated, and a mono sound from the left and right speakers will add up coherently at both listener positions. A number of publications and patents exist that in one way or another treat the near-side bias problem using methods as described above, that is, by identifying frequency bands which are classified according to whether two audio channels are predominantly in-phase or predominantly out-of-phase at both listener positions. A phase adjustment, adding a phase difference of 180 degrees to the channels, is then performed in the frequency bands where the channels are predominantly out-of-phase [2, 3, 4].

Thus, in order to solve the idealized near-side bias problem of FIG. 4, where it is assumed that listeners are positioned symmetrically off the center axis and that the IDP depends only on the delay difference between channels, it is sufficient to apply methods of prior art. That is, to realize an additional phase difference of 180 degrees between the channels, by means of applying phase shifting filters to one or both of the channels, in frequency bands where the system in predominantly out-of-phase.

In nearly all real-world cases, however, listeners may be positioned asymmetrically with respect to the center axis, and the IDP at various positions does not depend solely on the loudspeaker-listener distances but is a more complicated function of frequency.

LIMITATIONS OF PRIOR ART

The following limitations have been identified with the prior art solutions to the near-side bias problem:

- Prior art relies on assumptions of ideal symmetry with regard to the spatial layout of loudspeaker-listener positions, and with regard to the loudspeaker and room characteristics. In practical situations, assumptions of ideal symmetry will not be valid, due to more or less asymmetrical positioning of listeners, and due to asymmetries in the loudspeaker-room environment. Hence the phase shifting filters constructed according to the prior art may not be able to correctly attain the intended effect. FIG. 9 shows the IDP between the left and right front loudspeakers in a real automobile, in the left front seat (black line) and in the right front seat (grey line). It can be observed in FIG. 9 that there are frequencies where the IDP is outside of the ±90 degree interval in one seat and inside of the ±90 degree interval in the other seat. At those frequencies, the system as a whole cannot be classified as either predominantly out-of-phase or predominantly in-phase.
- Prior art methods are based on an assumption that the IDP at a listener position depends solely on the physical distances from the listener position to two loudspeakers. In many cases, however, the physical dimensions of a loudspeaker is large enough that there is no unambiguous way of determining its distance from a listener position, and thus the acoustic propagation delay from a loudspeaker to a listener position does not necessarily correspond to a linearly increasing phase response. The IDP is therefore not linearly increasing or decreasing with frequency, but is a more complicated function. There may also be several, spatially separated, loudspeaker elements connected to the same audio channel, which makes the IDP even more complicated. Again, FIG. 9 shows an example of the complexity of the IDP in a real acoustic environment.
- Prior art provides no solution to the situation when there are more than two listeners. For example, one may think of a situation as in FIG. 8, where one more listener position is added compared to the example of FIG. 4, so that the third listener has a pair of distances to the left and right loudspeakers, $d_3$ and $d_4$, that are not shared by the other two listeners. The IDP functions would then behave as in FIG. 10, where the IDP function at the third listener position is indicated with a dashed line. It can be seen in FIG. 10 that the third listener position will have a predominantly out-of-phase character at some frequencies where the first two listener positions will have a predominantly in-phase character, and vice versa. It is thus unclear how to construct phase shifting filters for reducing the IDP for all listeners.
- Prior art does not take spatial robustness into account. It may sometimes be desirable to adjust the phase in a more cautious manner, so that the reduction of the IDP between channels is valid for extended regions in space rather than for a small number of fixed listener positions. Taking spatial robustness into account, the maximum performance is likely to decrease, but instead acceptable performance can be attained in a larger spatial region.

In order to find a solution to the near-side bias problem that is both flexible and well adapted to practical real-world situations, it is thus desirable to overcome one or more of the prior art limitations.

SUMMARY OF THE INVENTION

It is an object to provide an improved method for determining phase adjustment filters for an associated sound generating system.

It is another object to provide a system for determining phase adjustment filters for an associated sound generating system.

It is also an object to provide a method for performing phase adjustments to at least two audio reproduction channels.

Yet another object is to provide an audio filter system for performing phase adjustments to at least two audio reproduction channels.

It is also an object to provide a computer program for determining, when executed by a computer, phase adjustment filters for an associated sound generating system.

Yet another object is to provide a computer-program product comprising a computer-readable medium having stored thereon such a computer program.

Still another object is to provide an apparatus for determining phase adjustment filters for an associated sound generating system.

It is also an object to provide a phase adjustment filter or a pair of phase adjustment filters.

Yet another object is to provide an audio system comprising a sound generating system and associated phase adjustment filters.

It is a further object to provide a digital audio signal generated by at least one phase adjustment filter.

These and other objects are met by embodiments of the proposed technology.

According to a first aspect, there is provided a method for determining phase adjustment filters for an associated sound generating system comprising at least two audio reproduction channels $C_1$ and $C_2$, where each of said audio reproduction channels $C_1$ and $C_2$ has an input signal and at least one loudspeaker located in a listening environment, wherein said method comprises:

estimating, for each of said audio reproduction channels $C_1$ and $C_2$, an acoustic transfer function at each of $M \geq 1$ spatial positions in said listening environment, based on sound measurements at said spatial positions; and determining, based on said acoustic transfer functions, phase adjustment filters $F_1(f)$ and $F_2(f)$ to be applied, respectively, to said audio reproduction channels $C_1$ and $C_2$, to reduce the inter-loudspeaker differential phase (IDP) between said audio reproduction channels $C_1$ and $C_2$ in p listener positions.

According to a second aspect, there is provided a system for determining phase adjustment filters for an associated sound generating system comprising at least two audio reproduction channels $C_1$ and $C_2$, where each of said audio reproduction channels $C_1$ and $C_2$ has an input signal and at least one loudspeaker located in a listening environment, wherein said system is configured to estimate, for each of said audio reproduction channels $C_1$ and $C_2$, an acoustic transfer function at each of $M \geq 1$ spatial positions in said listening environment, based on sound measurements at said spatial positions; and wherein said system is configured to determine, based on said acoustic transfer functions, phase adjustment filters $F_1(f)$ and $F_2(f)$ to be applied, respectively, to said audio reproduction channels $C_1$ and $C_2$, to reduce the IDP between said audio reproduction channels $C_1$ and $C_2$ in p listener positions.

According to a third aspect, there is provided a method for performing phase adjustments to at least two audio reproduction channels $C_1$ and $C_2$, where each of said audio reproduction channels $C_1$ and $C_2$ has an input signal and at least one loudspeaker located in a listening environment, wherein said method comprises applying digital filters $F_1(f)$ and $F_2(f)$ on the input signals of said audio reproduction channels $C_1$ and $C_2$, respectively, to reduce the IDP between said audio reproduction channels $C_1$ and $C_2$ in p listener positions in said listening environment, said IDP being determined based on acoustic transfer functions in said M spatial positions, wherein said digital filters are performing phase adjustments to said audio reproduction channels $C_1$ and $C_2$ that counteract said IDP.

According to a fourth aspect, there is provided an audio filter system for performing phase adjustments to at least two audio reproduction channels $C_1$ and $C_2$, where each of said audio reproduction channels $C_1$ and $C_2$ has an input signal and at least one loudspeaker located in a listening environment, wherein said system is configured to apply digital filters $F_1(f)$ and $F_2(f)$ on the input signals of said audio reproduction channels $C_1$ and $C_2$, respectively, to reduce the IDP between said audio reproduction channels $C_1$ and $C_2$ in p listener positions in said listening environment, said IDP being determined based on acoustic transfer functions in said M spatial positions, wherein said digital filters are configured to perform phase adjustments to said audio reproduction channels $C_1$ and $C_2$ that counteract said IDP.

According to a fifth aspect, there is provided a computer program for determining, when executed by a computer, phase adjustment filters for an associated sound generating system comprising at least two audio reproduction channels $C_1$ and $C_2$, where each of said audio reproduction channels $C_1$ and $C_2$ has an input signal and at least one loudspeaker located in a listening environment, wherein said computer program comprises instructions, which when executed by said computer, cause said computer to:

estimate, for each of said audio reproduction channels $C_1$ and $C_2$, an acoustic transfer function at each of $M \geq 1$ spatial positions in said listening environment, based on sound measurements at said spatial positions; and determine, based on said acoustic transfer functions, phase adjustment filters $F_1(f)$ and $F_2(f)$ to be applied, respectively, to said audio reproduction channels $C_1$ and $C_2$, to reduce the IDP between said audio reproduction channels $C_1$ and $C_2$ in p listener positions.

According to a sixth aspect, there is provided a computer-program product comprising a computer-readable medium having stored thereon such a computer program as described herein.

According to a seventh aspect, there is provided an apparatus for determining phase adjustment filters for an associated sound generating system comprising at least two audio reproduction channels $C_1$ and $C_2$, where each of said audio reproduction channels $C_1$ and $C_2$ has an input signal and at least one loudspeaker located in a listening environment, wherein said apparatus comprises:

an estimation module for estimating, for each of said audio reproduction channels $C_1$ and $C_2$, an acoustic transfer function at each of $M \geq 1$ spatial positions in said listening environment, based on sound measurements at said spatial positions; and a determination module for determining, based on said acoustic transfer functions, phase adjustment filters $F_1(f)$ and $F_2(f)$ to be applied, respectively, to said audio reproduction channels $C_1$ and $C_2$, to reduce the IDP between said audio reproduction channels $C_1$ and $C_2$ in p listener positions.

According to an eighth aspect, there is provided a phase adjustment filter or a pair of phase adjustment filters determined by using the method described herein.

According to a ninth aspect, there is provided an audio system comprising a sound generating system and associated phase adjustment filters $F_1(f)$ and $F_2(f)$ applied, respectively, to a pair of channels $C_1$ and $C_2$ of the system, where said phase adjustment filters $F_1(f)$ and $F_2(f)$ are determined by using the method described herein.

According to a tenth aspect, there is provided a digital audio signal generated by at least one phase adjustment filter determined by using the method described herein.

The proposed technology offers at least one of the following advantages:

Provides an improved stereo image when the IDP of two audio reproduction channels is not symmetrical with respect to a center axis between two loudspeakers.

Provides an improved stereo image when the IDP of two audio reproduction channels at some listener positions has a more complicated behavior than being merely a function of the distance between the listener position and two loudspeakers.

Provides an improved stereo image for multiple listeners when there are more than two listener positions.

Provides an better spatial robustness so that the improvement of the stereo image is valid even if the listeners move their heads within an allowed area.

DETAILED DESCRIPTION

The proposed technology will now be described in more detail with reference to various non-limiting, exemplary embodiments.

Figure 16:
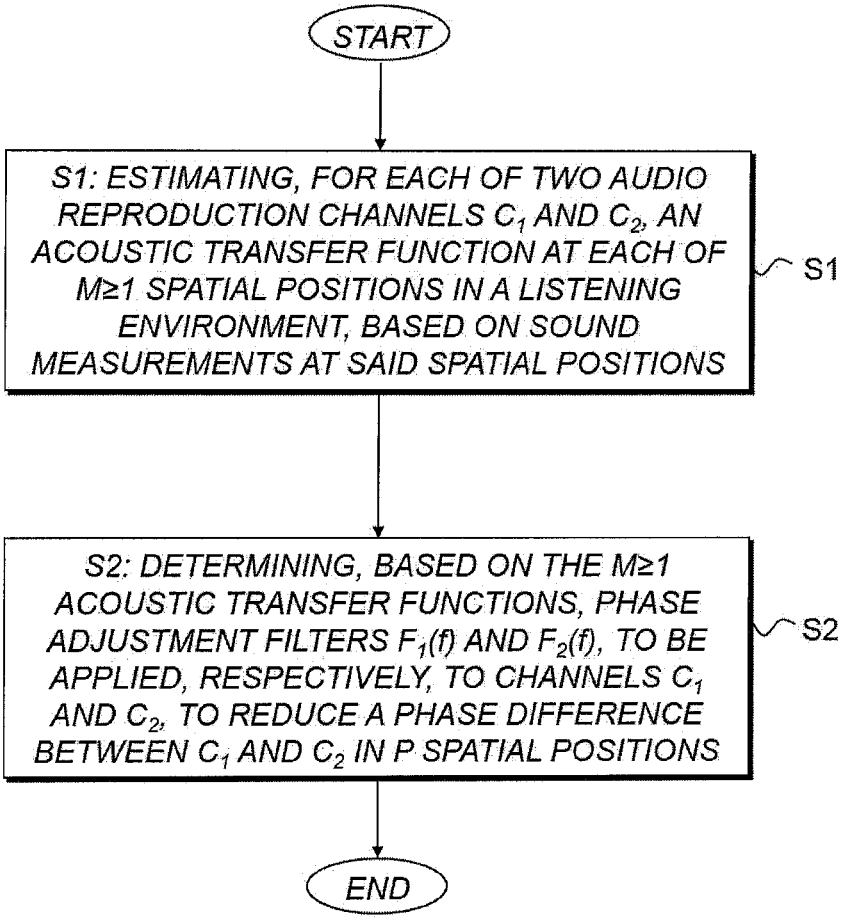
FIG. 16 is a schematic flow diagram illustrating an example of a method for determining phase adjustment filters for an associated sound generating system.

FIG. 16 is a schematic flow diagram illustrating an example of a method for determining phase adjustment filters for an associated sound generating system comprising at least two audio reproduction channels $C_1$ and $C_2$ where each of said audio reproduction channels $C_1$ and $C_2$ has an input signal and at least one loudspeaker located in a listening environment.

The method comprises:

S1: estimating, for each of said audio reproduction channels $C_1$ and $C_2$, an acoustic transfer function at each of $M \geq 1$ spatial positions in said listening environment, based on sound measurements at said spatial positions; and S2: determining, based on said acoustic transfer functions, phase adjustment filters $F_1(f)$ and $F_2(f)$ to be applied, respectively, to said audio reproduction channels $C_1$ and $C_2$, to reduce the inter-loudspeaker differential phase (IDP) between said audio reproduction channels $C_1$ and $C_2$ in p listener positions.

By way of example, the step of determining phase adjustment filters comprises:

determining p IDP functions $\phi_1(f), \phi_2(f), \ldots, \phi_p(f)$ between said audio reproduction channels, in a frequency interval $f_1 \leq f \leq f_2$, based on information from said acoustic transfer functions at said M spatial positions;

determining an aggregated IDP function $\overline{\phi}(f)$ based on said p IDP functions $\phi_1(f), \phi_2(f), \ldots, \phi_p(f)$; and computing said phase adjustment filters $F_1(f)$ and $F_2(f)$ based on said aggregated IDP function.

In a particular example, the step of computing said phase adjustment filters $F_1(f)$ and $F_2(f)$ based on said aggregated IDP function comprises:

determining phase adjustment functions, $\psi_1(f)$ and $\psi_2(f)$ based on said aggregated IDP function $\overline{\phi}(f)$; and computing said phase adjustment filters $F_1(f)$ and $F_2(f)$ based on said phase adjustment functions, $\psi_1(f)$ and $\psi_2(f)$.

As an example, the aggregated IDP function is an average IDP function.

According to another aspect, there is provided a method for performing phase adjustments to at least two audio reproduction channels $C_1$ and $C_2$, where each of said audio reproduction channels $C_1$ and $C_2$ has an input signal and at least one loudspeaker located in a listening environment, wherein said method comprises applying digital filters $F_1(f)$ and $F_2(f)$ on the input signals of said audio reproduction channels $C_1$ and $C_2$, respectively, to reduce the IDP between said audio reproduction channels $C_1$ and $C_2$ in p listener positions in said listening environment, said IDP being determined based on acoustic transfer functions in said M spatial positions, wherein said digital filters are performing phase adjustments to said audio reproduction channels $C_1$ and $C_2$ that counteract said IDP.

By way of example, the digital filters are performing said phase adjustments even when the IDP is smaller than ±90 degrees.

In a particular example, the IDP is an aggregated IDP of a number of IDPs between said audio reproduction channels, in a frequency interval $f_1 \leq f \leq f_2$, each of which being determined based on information from said acoustic transfer functions at said M spatial positions.

For example, the aggregated IDP may be an average IDP.

In the following, the proposed technology will be described with reference to non-limiting examples.

It is an object of the present invention to improve the perceived sound image of a stereophonic audio signal, played back through a sound reproduction system having at least two channels $C_1$ and $C_2$, with one input signal per channel and at least one loudspeaker per channel. The improvement is made with respect to one or more listener positions, where the inter-loudspeaker differential phase (IDP) between the channels $C_1$ and $C_2$ is nonzero in at least one of the listener positions. The object is achieved by performing frequency-dependent phase adjustments to the channels $C_1$ and $C_2$, thereby reducing the overall IDP between the channels, as evaluated using transfer function measurements at $M \geq 1$ positions.

In the context of the present invention, a listener position is associated either with one single point or with a pair of points in space, selected from a total of $M \geq 1$ measurement points.

Figure 1:
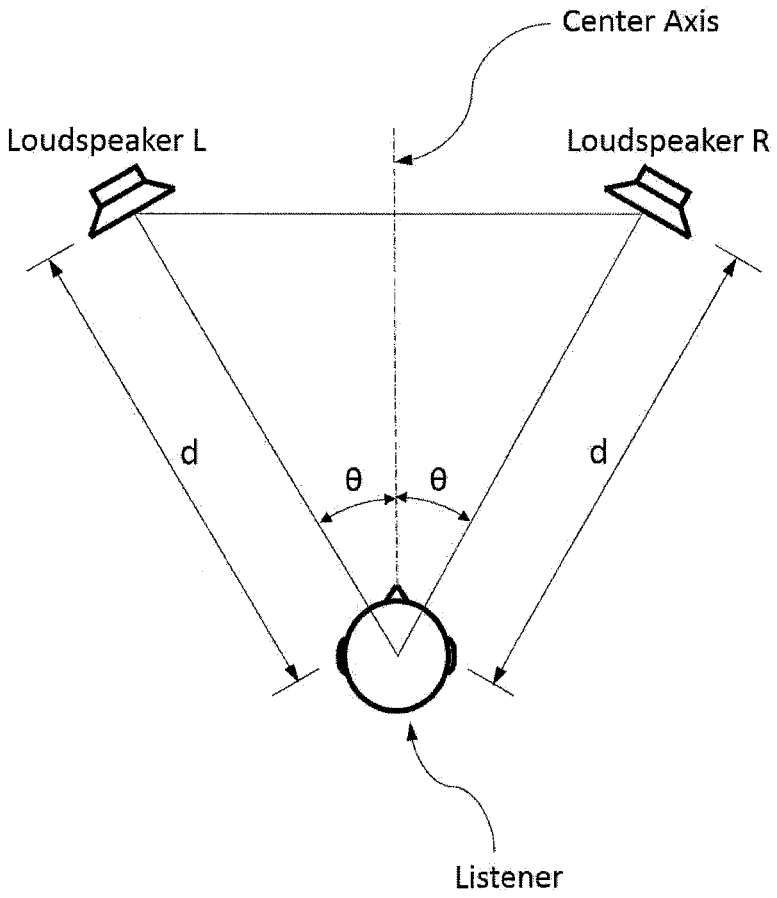
FIG. 1 illustrates a stereo playback system where the listener is located on the center axis, at equal distance from the loudspeakers.
Figure 2:
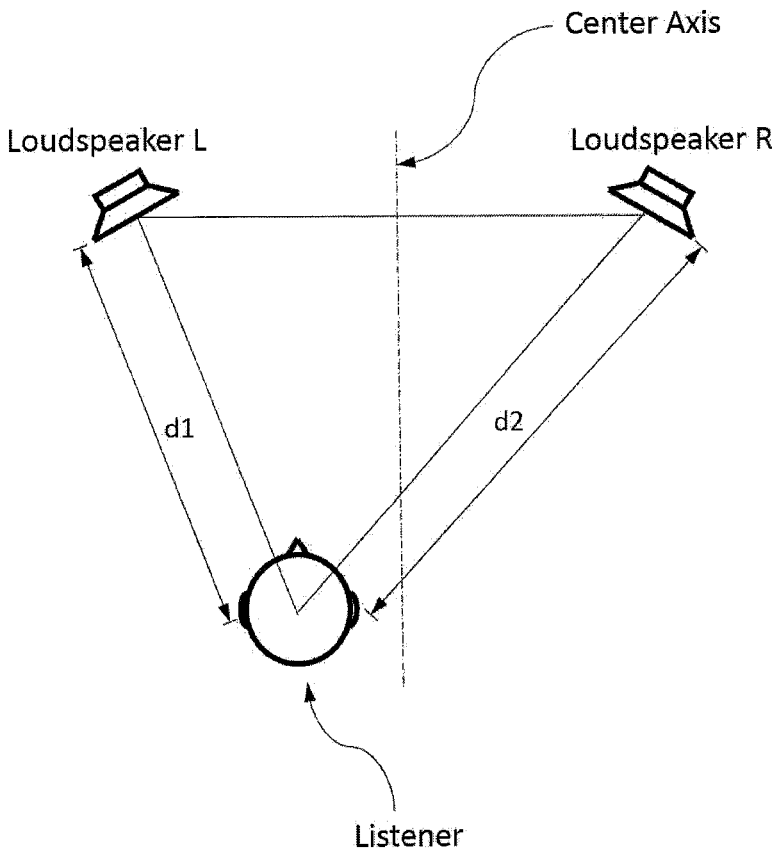
FIG. 2 illustrates a stereo playback system where the listener is located off from the center axis, at distance d1 from the left loudspeaker and distance d2 from the right loudspeaker. The listener will experience a near-side bias to the left.
Figure 3:
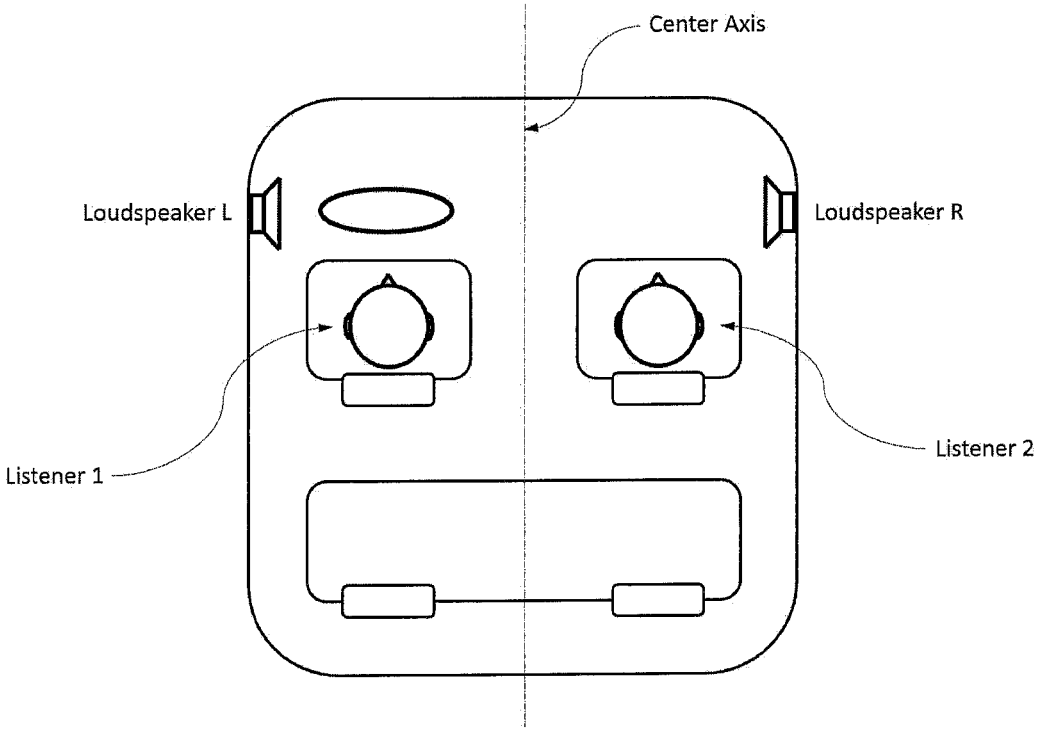
FIG. 3 is a schematic view of a stereo playback system in an automobile, where two listeners are located at each side of the center axis. The left listener will experience a near-side bias to the left and the right listener will experience a near-side bias to the right.
Figure 4:
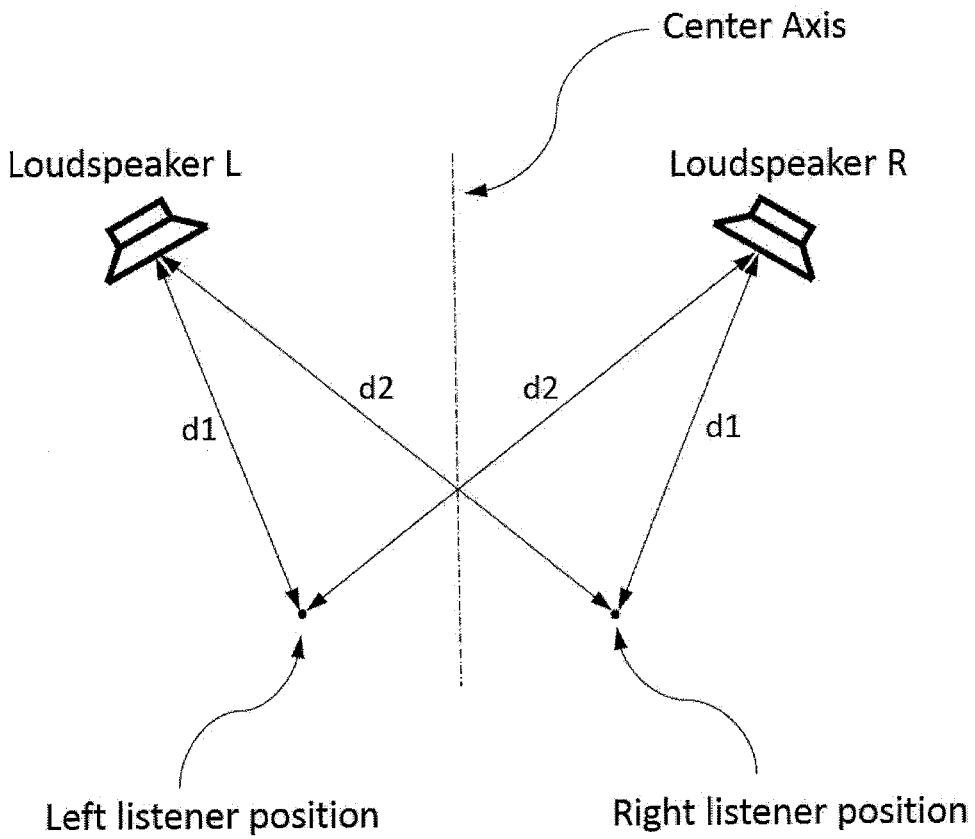
FIG. 4 illustrates a stereo playback system with two listener positions, where both listener positions are located off from the center axis and with ideal symmetry, at distance d1 from the nearest loudspeaker and distance d2 from the loudspeaker on the opposite side. The left listener will experience a near-side bias to the left and the right listener will experience a near-side bias to the right.
Figure 5:
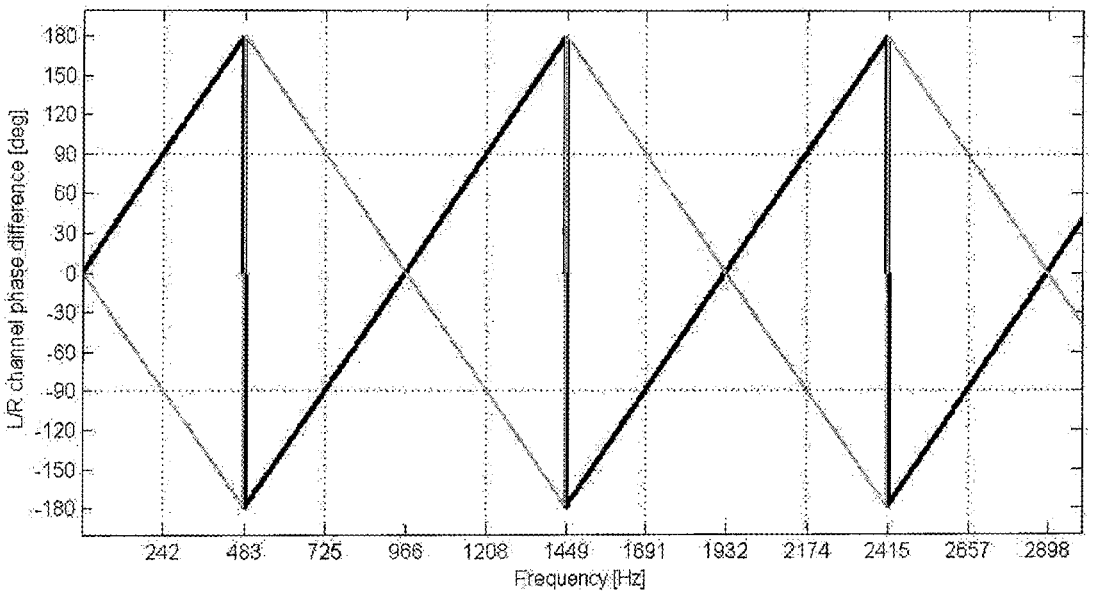
FIG. 5 illustrates the inter-loudspeaker differential phase (IDP) between the left and right loudspeakers, as experienced at the left and right listener positions in FIG. 4. The black line is the IDP at the left listener position, and the grey line is the IDP at the right listener position.
Figure 6:
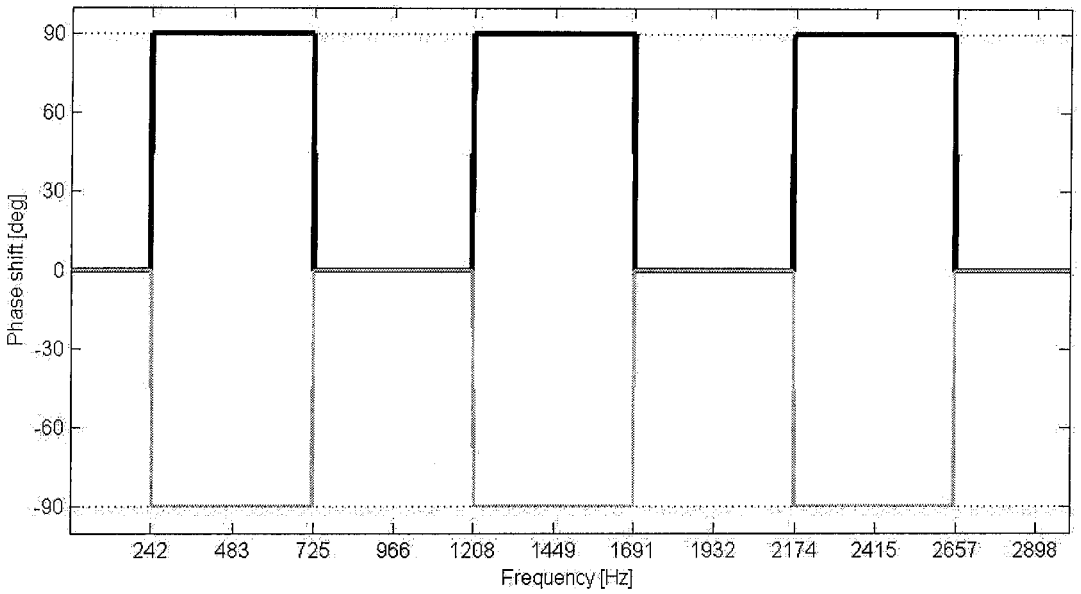
FIG. 6 illustrates the phase responses of two phase shifting filters whose total phase difference is either 0° or 180°, in sequential frequency bands. The black line is the phase response of the first filter and the grey line is the phase response of the second filter.
Figure 7:
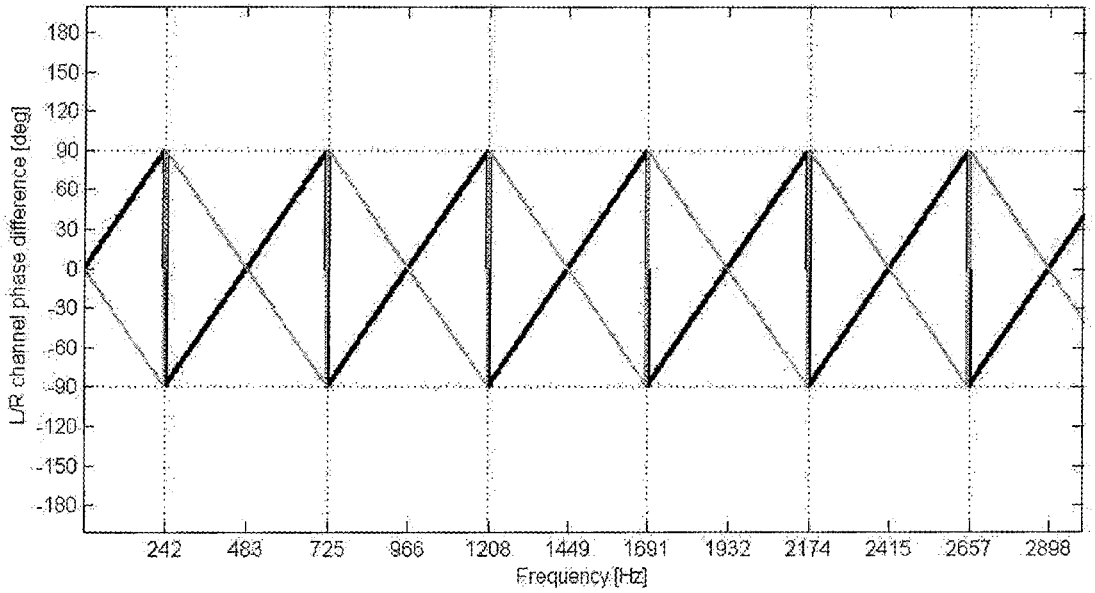
FIG. 7 illustrates the IDP functions that result from applying the filters of FIG. 6 to the left and right channels of the system described by FIG. 4 and FIG. 5. The black line is the IDP at the left listener position and the grey line is the IDP at the right listener position
Figure 8:
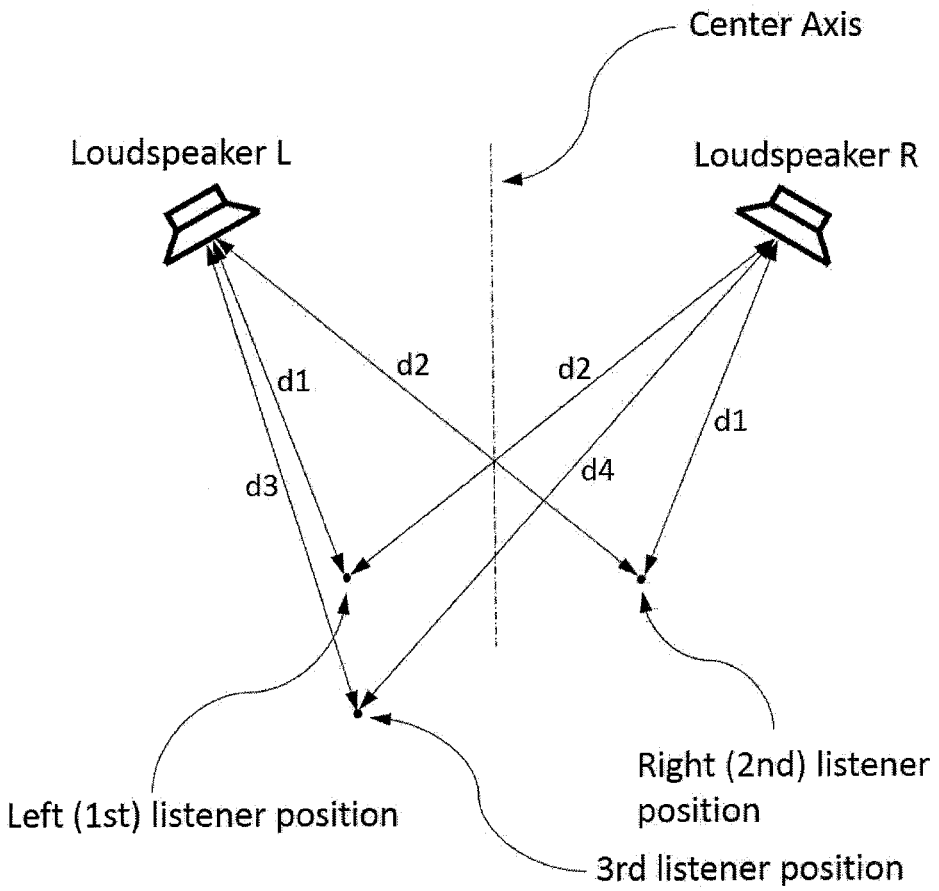
FIG. 8 illustrates a stereo playback system similar to that of FIG. 4 but with three listener positions.
Figure 9:
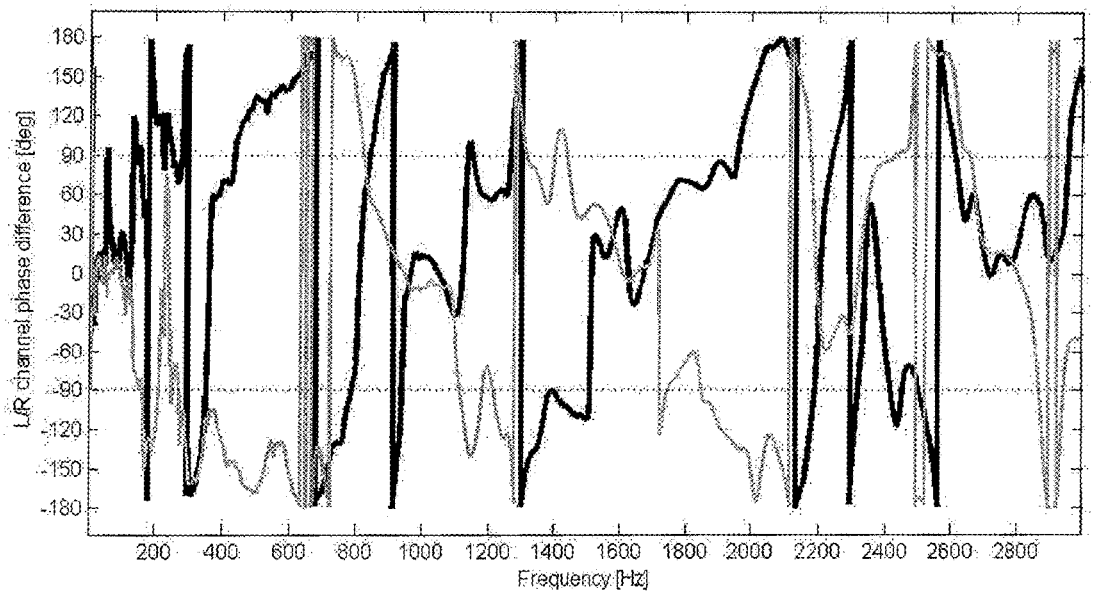
FIG. 9 illustrates the IDP functions as measured in the left and right front seats of an automobile. The black line is the IDP at the left front seat, and the grey line is the IDP at the right front seat.
Figure 10:
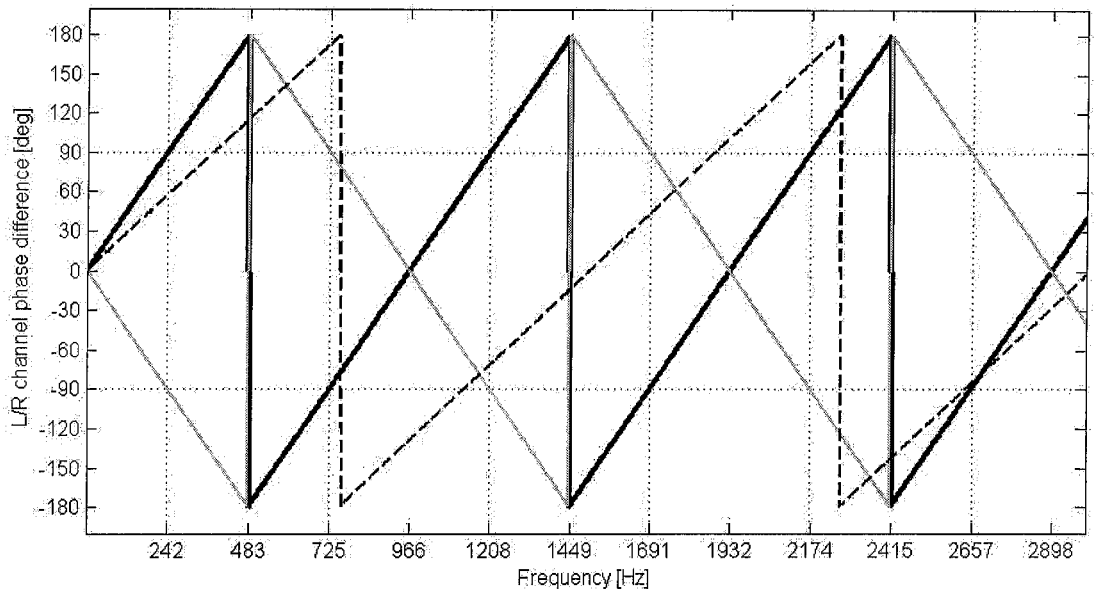
FIG. 10 illustrates the IDP between the left and right loudspeakers, as experienced at the three listener positions of FIG. 8. The black line is the IDP at the 1st listener position, the grey line is the IDP at the 2nd listener position and the dashed line is the IDP at the 3rd listener position.
Figure 11:
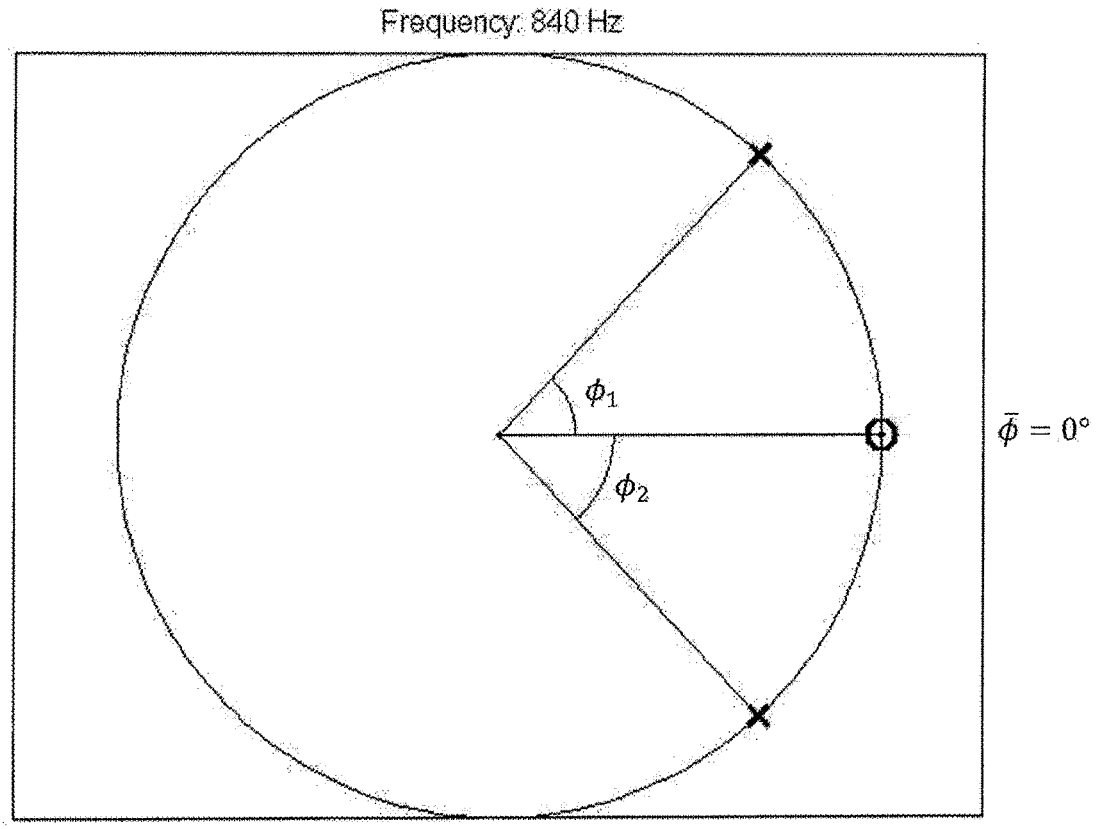
FIG. 11 illustrates the IDPs $\phi_1(f)$ and $\phi_2(f)$ at frequency $f$=840 Hz, corresponding to the situation of FIG. 4. Due to the symmetry of $\phi_1(f)$ and $\phi_2(f)$, the aggregated IDP $\overline{\phi}$ is equal to 0°.
Figure 12:
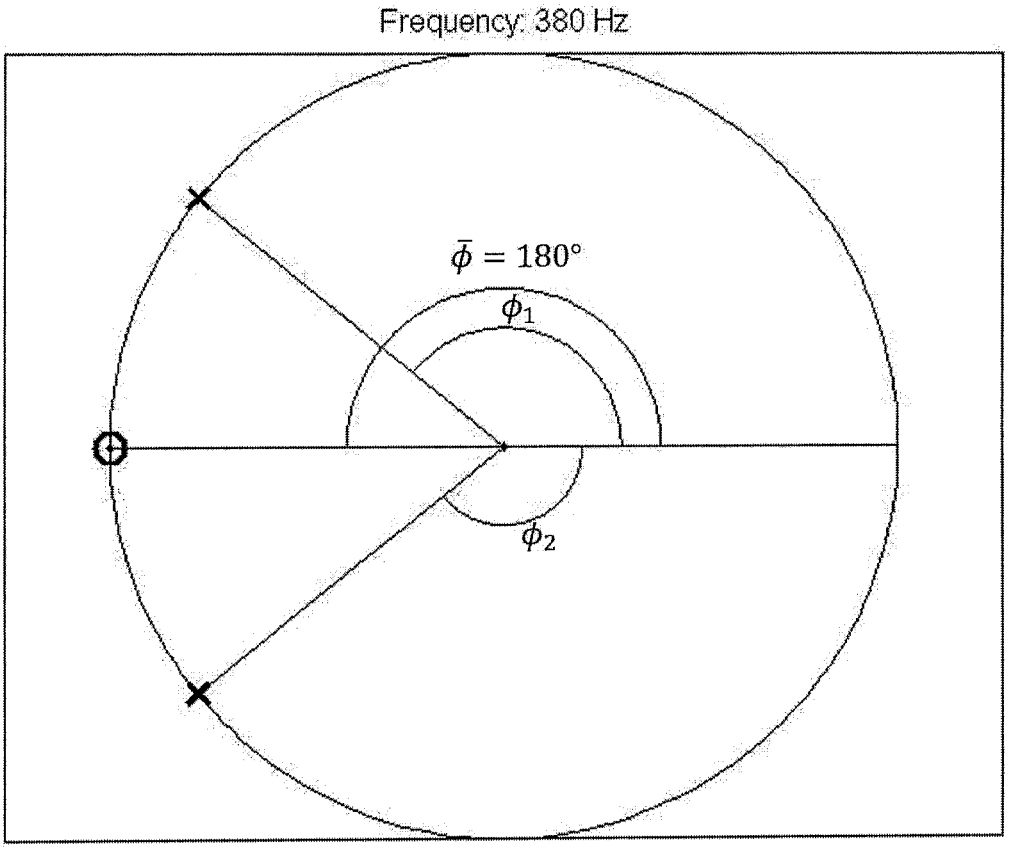
FIG. 12 illustrates the IDPs $\phi_1(f)$ and $\phi_2(f)$ at frequency $f$=380 Hz, corresponding to the situation of FIG. 4. At this frequency, the IDP is predominantly out-of-phase at both listener positions. Due to the symmetry of $\phi_1(f)$ and $\phi_2(f)$, the aggregated IDP $\overline{\phi}$ is equal to 180°.
Figure 13:
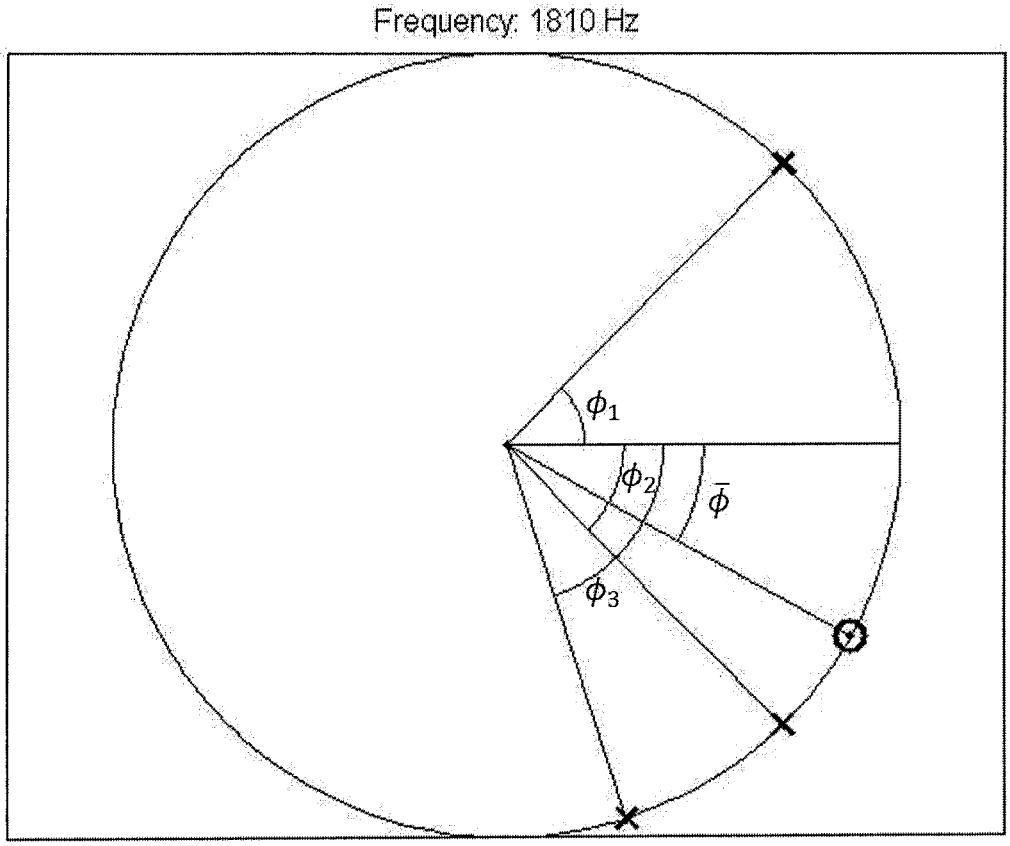
FIG. 13 illustrates the IDPs $\phi_1(f)$, $\phi_2(f)$ and $\phi_3(f)$ at frequency $f$=1810 Hz, corresponding to the situation of FIG. 8. At this frequency, the IDP is predominantly in-phase at all three listener positions, but because of the asymmetry of $\phi_3(f)$ relative to $\phi_1(f)$, $\phi_2(f)$ and the real axis, the aggregated IDP $\overline{\phi}$ is not equal to 0°.
Figure 14:
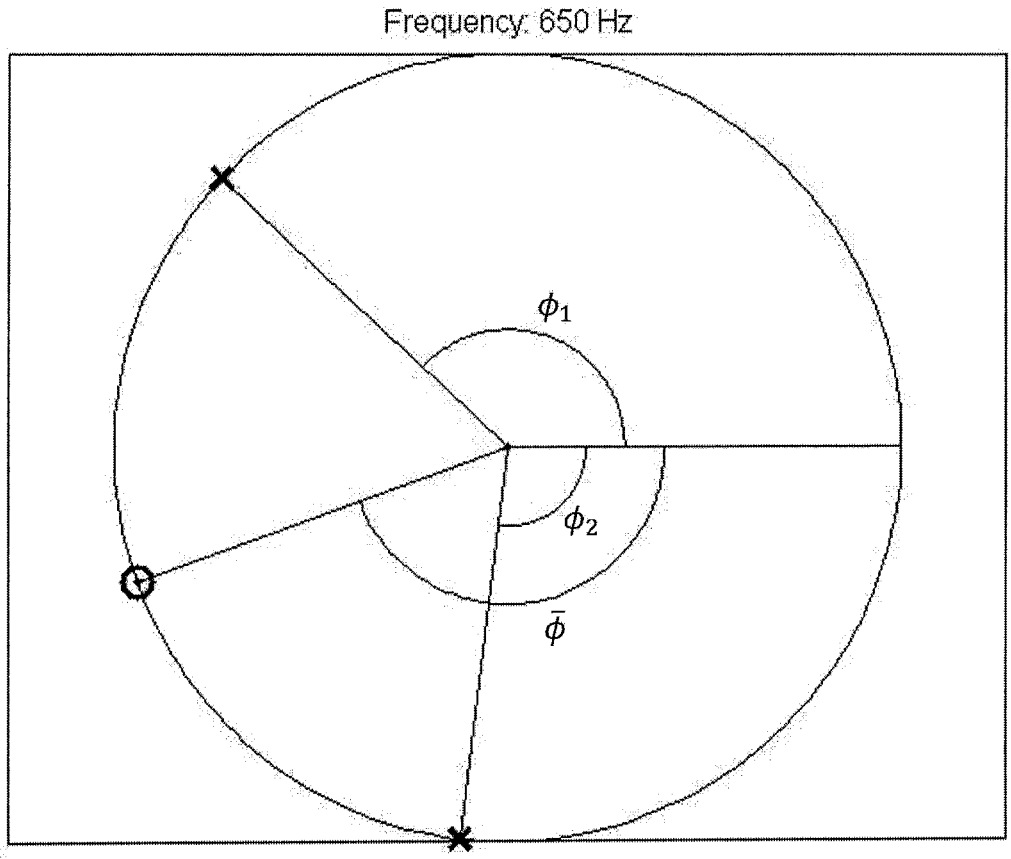
FIG. 14 illustrates the measured IDPs $\phi_1(f)$ and $\phi_2(f)$ of FIG. 9, at frequency $f$=650 Hz. At this frequency, the IDP is predominantly out-of-phase at both listener positions, but because of the asymmetry $\phi_1(f)$ and $\phi_2(f)$ relative to the real axis, the aggregated IDP $\overline{\phi}$ is not equal to 180°.
Figure 15:
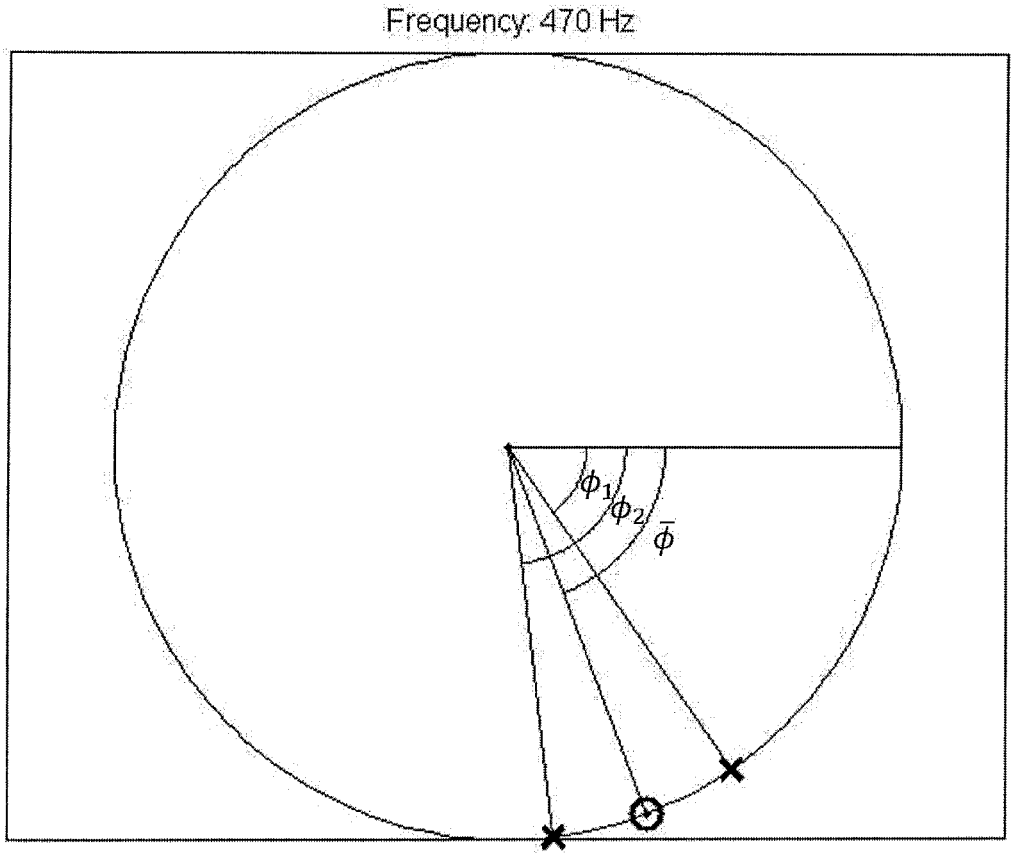
FIG. 15 illustrates the measured IDPs $\phi_1(f)$ and $\phi_2(f)$ of FIG. 9, at frequency $f$=470 Hz. At this frequency, the IDP is predominantly in-phase at both listener positions, but because of the asymmetry $\phi_1(f)$ and $\phi_2(f)$ relative to the real axis, the aggregated IDP $\overline{\phi}$ is not equal to 0°.

According to a non-limiting example of the present invention, the IDP at each of p listener positions is obtained from a pair of measured acoustic transfer functions $H_{1i}(f)$ and $H_{2i}(f)$ representing channels $C_1$ and $C_2$ at the ith listener position (i=1, 2, . . . , p), by calculating the phase difference $\phi_i(f)$ between $H_{1i}(f)$ and $H_{2i}(f)$, as for example $\phi_i(f)=\angle H_{1i}(f)-\angle H_{2i}(f)$. The so obtained values of $\phi_i(f)$ are then represented as points $z_i(f)$ on the unit circle in the complex plane, where the phase angle $\phi_i(f)$ corresponds to the angle of the point $z_i(f)$ from the real axis. FIG. 11 illustrates an example of this procedure where the IDPs $\phi_1$ and $\phi_2$ at frequency $f$=840 Hz have been calculated based on the idealized symmetrical situation in FIG. 4 and FIG. 5. In accordance with the symmetry of the IDPs in FIG. 5, it can be seen in FIG. 11 that the IDPs $\phi_1$ and $\phi_2$, when represented as points $z_1$ and $z_2$ on the unit circle (marked with black crosses), are located symmetrically with respect to the real axis. FIG. 13 illustrates the same procedure when IDPs $\phi_1$, $\phi_2$ and $\phi_3$ at frequency $f$=1810 have been calculated based on the three-listener situation of FIG. 8 and FIG. 10. FIG. 14 and FIG. 15 illustrate, respectively, the measured IDPs of FIG. 9 at $f$=650 Hz and $f$=470 Hz, using the above described unit-circle representation.

According to another example, an aggregated IDP function $\overline{\phi}(f)$ is obtained by using the above described unit-circle representation of the individual IDP functions $\phi_1(f), \phi_2(f), \ldots, \phi_p(f)$ to compute an average IDP. If the IDPs $\phi_1(f), \phi_2(f), \ldots, \phi_p(f)$ are represented in degrees, that is, $-180° \leq \phi_i(f) \leq 180°$, then their respective complex unit-circle representations $z_1(f), z_2(f), \ldots, z_p(f)$ are obtained as $z_i(f)=\exp(\jmath\pi\phi_i(f)/180)$, where $\jmath=\sqrt{-1}$, and the average IDP is then the complex average of $z_1(f), z_2(f), \ldots, z_p(f)$ projected back onto the unit circle. This averaging operation can be written for example as $$\overline{\phi}(f) = \exp\left(\jmath \angle\left\{\frac{1}{p}[z_1(f) + z_2(f) + \ldots + z_p(f)]\right\}\right).$$

In FIG. 11-FIG. 15, the value of the aggregated IDP function $\overline{\phi}$, represented with a black circle, was computed using the averaging method described above. It can be seen from FIG. 11 and FIG. 12 that the aggregated IDP function $\overline{\phi}$ in the idealized two-listener case, if computed as above, will take a value of 0° whenever $\phi_1$ and $\phi_2$ are within ±90° (predominantly in-phase) and a value of 180° whenever $\phi_1$ and $\phi_2$ are outside of ±90° (predominantly out-of-phase). Consequently, if the aggregated IDP function $\overline{\phi}(f)$, computed as above, is used as a basis for designing phase shifting filters that counteract $\overline{\phi}(f)$ in an idealized symmetrical two-listener case, then those phase shifting filters will strive to do nothing at frequencies where the IDP is predominantly in-phase, and they will strive to add a phase difference of 180° at frequencies where the IDP is predominantly out-of-phase.

For a real sound system in a real acoustic environment, however, the IDP between two channels will most likely behave as in FIG. 14 and FIG. 15 at most frequencies. That is, the IDP values $\phi_1$ and $\phi_2$ will not be symmetrical with respect to the real axis, and there is no guarantee that the system will be either predominantly in-phase or predominantly out-of-phase at all listener positions. Thus a simple rule such as adding a phase difference of either 0° or 180° to the channels would not be effective.

According to an example of the present invention, the aggregated IDP function $\overline{\phi}(f)$, computed as described above, is used for defining the phase difference that should be applied to the channels by filters $F_1(f)$ and $F_2(f)$. Such a filter design strategy implies that the phase shifting filters will strive to correct the IDP even when the IDP functions are within ±90° at all listener positions (predominantly in-phase but with a nonzero value of $\overline{\phi}(f)$), as is the case in FIG. 15.

In yet another example, the phase responses of the filters $F_1(f)$ and $F_2(f)$ are determined by a partitioning of the aggregated IDP $\overline{\phi}(f)$ into two phase response curves $\psi_1(f)$ and $\psi_2(f)$. The goal is then to obtain filters for channels $C_1$ and $C_2$ having phase responses $\omega_1(f)$ and $\psi_2(f)$, that is, $\angle F_1(f)=\psi_1(f)$ and $\angle F_2(f)=\psi_2(f)$, where $\psi_1(f)$ and $\psi_2(f)$ are such that $\psi_1(f)-\psi_2(f)=-\overline{\phi}(f)$. The partitioning of $\overline{\phi}(f)$ can, for example, be accomplished by selecting either $\psi_1(f)=-\overline{\phi}(f)$ and $\psi_2(f)=0$, or $\psi_1(f)=0$ and $\psi_2(f)=\overline{\phi}(f)$. Another option is to select a partitioning such that both $\psi_1(f)$ and $\psi_2(f)$ are monotonically decreasing functions of frequency, in which case the group delay function of both filters $F_1(f)$ and $F_2(f)$ will be strictly nonnegative.

Figure 19:
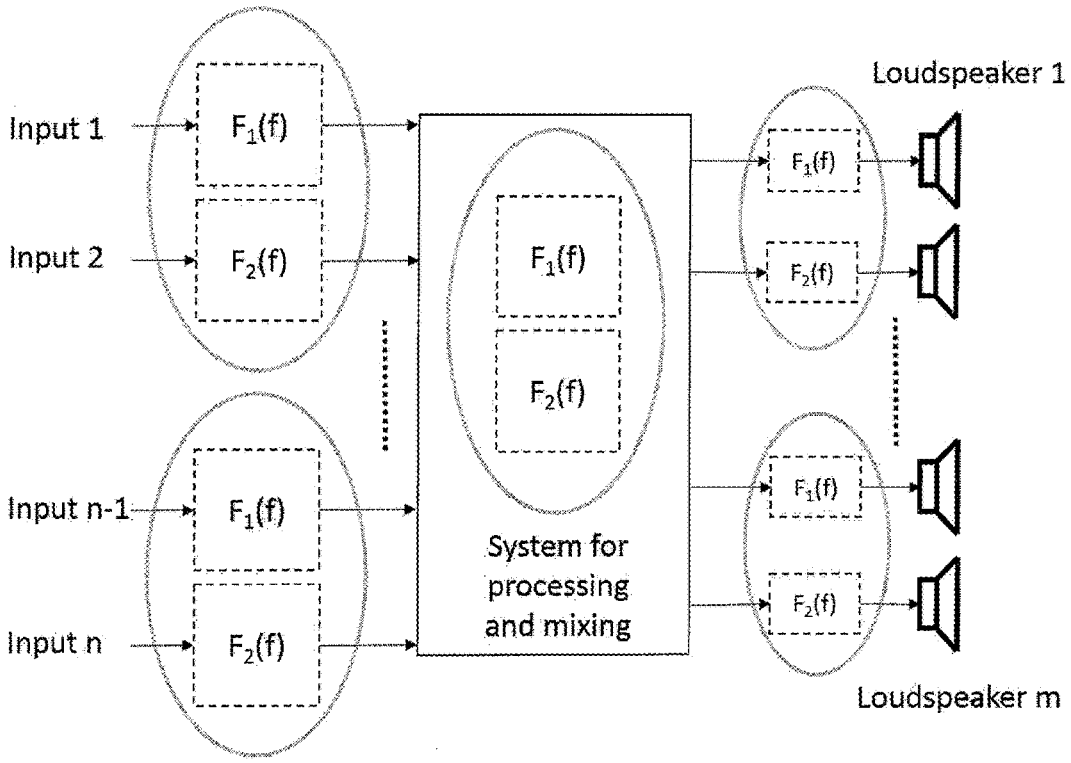
FIG. 19 shows a schematic view of a sound reproducing system, containing some examples of alternative locations in the signal chain where phase shifting filters $F_1(f)$ and $F_2(f)$ can be placed.

According to yet another example, the filters $F_1(f)$ and $F_2(f)$ are implemented into the signal chain of a sound reproducing system. The location of the filters within the signal chain depends on which parts of the system are considered to represent the pair of channels $C_1$ and $C_2$. For example, the channel pair $C_1$ and $C_2$ may be associated with two inputs of the system, or they may be associated with two specific loudspeakers and therefore be located at the outputs of the system. Alternatively, the channels $C_1$ and $C_2$ can be thought of as signal sub-chains inside a signal processing and mixing unit, in which case the filters $F_1(f)$ and $F_2(f)$ can be seen as processing steps integrated inside that unit. FIG. 19 shows a schematic view of a sound reproducing system, containing some examples of locations in the signal chain where the phase shifting filters $F_1(f)$ and $F_2(f)$ can be placed.

It will be appreciated that the methods and arrangements described herein can be implemented, combined and re-arranged in a variety of ways.

For example, embodiments may be implemented in hardware, or in software for execution by suitable processing circuitry, or a combination thereof.

The steps, functions, procedures, modules and/or blocks described herein may be implemented in hardware using any conventional technology, such as discrete circuit or integrated circuit technology, including both general-purpose electronic circuitry and application-specific circuitry.

Alternatively, or as a complement, at least some of the steps, functions, procedures, modules and/or blocks described herein may be implemented in software such as a computer program for execution by suitable processing circuitry such as one or more processors or processing units.

Examples of processing circuitry includes, but is not limited to, one or more microprocessors, one or more Digital Signal Processors (DSPs), one or more Central Processing Units (CPUs), video acceleration hardware, and/or any suitable programmable logic circuitry such as one or more Field Programmable Gate Arrays (FPGAs), or one or more Programmable Logic Controllers (PLCs).

It should also be understood that it may be possible to re-use the general processing capabilities of any conventional device or unit in which the proposed technology is implemented. It may also be possible to re-use existing software, e.g. by reprogramming of the existing software or by adding new software components.

According to an aspect of the proposed technology there is provided a system for determining phase adjustment filters for an associated sound generating system comprising at least two audio reproduction channels $C_1$ and $C_2$, where each of said audio reproduction channels $C_1$ and $C_2$ has an input signal and at least one loudspeaker located in a listening environment, wherein said system is configured to estimate, for each of said audio reproduction channels $C_1$ and $C_2$, an acoustic transfer function at each of $M \geq 1$ spatial positions in said listening environment, based on sound measurements at said spatial positions; and wherein said system is configured to determine, based on said acoustic transfer functions, phase adjustment filters $F_1(f)$ and $F_2(f)$ to be applied, respectively, to said audio reproduction channels $C_1$ and $C_2$, to reduce the IDP between said audio reproduction channels $C_1$ and $C_2$ in p listener positions.

By way of example, the system is configured to determine p IDP functions $\phi_1(f)$, $\phi_2(f)$, . . . , $\phi_p(f)$, to determine an aggregated IDP function $\overline{\phi}(f)$, and to compute said phase adjustment filters $F_1(f)$ and $F_2(f)$ based on said aggregated IDP function.

In a particular example, the system is configured to determine phase adjustment functions $\psi_1(f)$ and $\psi_2(f)$, based on said aggregated IDP function $\overline{\phi}(f)$, and to compute said phase adjustment filters $F_1(f)$ and $F_2(f)$ based on said phase adjustment functions $\psi_1(f)$ and $\psi_2(f)$.

In another example, the system comprises a processor and a memory, the memory comprising instructions executable by the processor, whereby the processor is operative to determine the phase adjustment filters as described herein.

Figure 17:
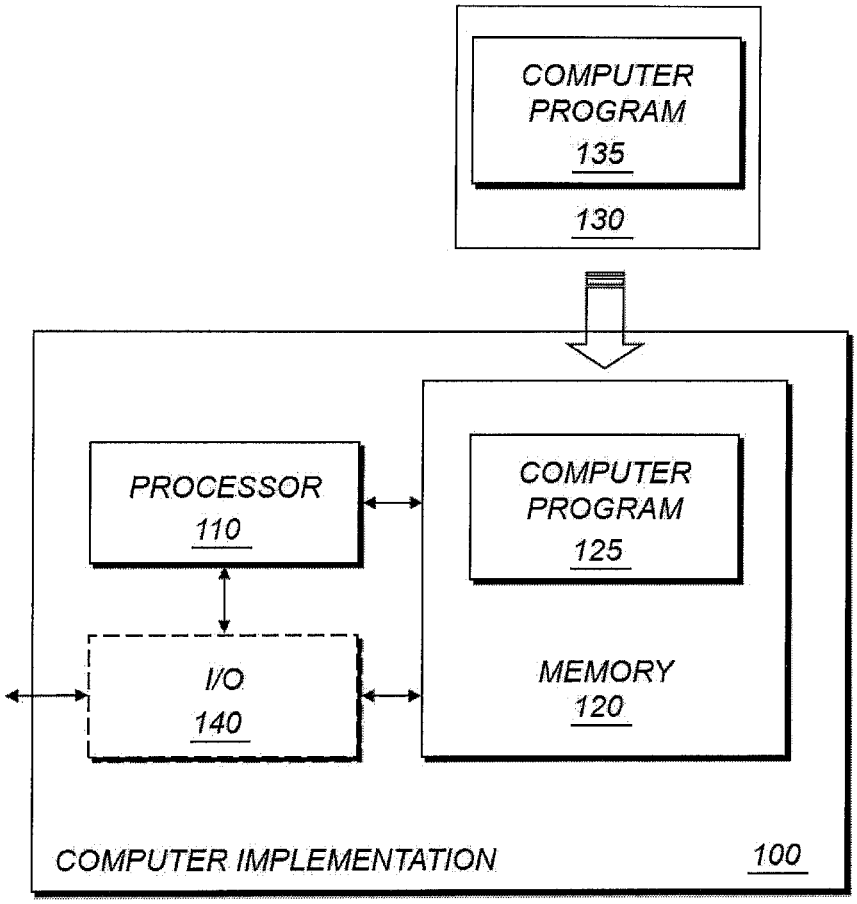
FIG. 17 is a schematic diagram illustrating an example of a computer implementation according to an embodiment of the present invention.

FIG. 17 is a schematic diagram illustrating an example of a computer-implementation 100 according to an embodiment. In this particular example, at least some of the steps, functions, procedures, modules and/or blocks described herein are implemented in a computer program 125; 135, which is loaded into the memory 120 for execution by processing circuitry including one or more processors 110. The processor(s) 110 and memory 120 are interconnected to each other to enable normal software execution. An optional input/output device 140 may also be interconnected to the processor(s) 110 and/or the memory 120 to enable input and/or output of relevant data such as input parameter(s) and/or resulting output parameter(s).

The term "processor" should be interpreted in a general sense as any system or device capable of executing program code or computer program instructions to perform a particular processing, determining or computing task.

The processing circuitry including one or more processors 110 is thus configured to perform, when executing the computer program 125, well-defined processing tasks such as those described herein.

The processing circuitry does not have to be dedicated to only execute the above-described steps, functions, procedure and/or blocks, but may also execute other tasks.

According to another aspect, there is also provided a corresponding audio filter system comprising phase adjustment filters as described herein.

In a particular example, there is provided an audio filter system for performing phase adjustments to at least two audio reproduction channels $C_1$ and $C_2$, where each of said audio reproduction channels $C_1$ and $C_2$ has an input signal and at least one loudspeaker located in a listening environment, wherein said system is configured to apply digital filters $F_1(f)$ and $F_2(f)$ on the input signals of said audio reproduction channels $C_1$ and $C_2$, respectively, to reduce the IDP between said audio reproduction channels $C_1$ and $C_2$ in p listener positions in said listening environment, said IDP being determined based on acoustic transfer functions in said M spatial positions, wherein said digital filters are configured to perform phase adjustments to said audio reproduction channels $C_1$ and $C_2$ that counteract said IDP.

Typically, a number of computational steps are performed on a separate computer system to produce the filter parameters of the phase adjustment filter(s). The calculated filter parameters are then normally downloaded or implemented into a digital filter, for example, realized by a digital signal processing system or customized processing circuitry, which executes the actual filtering.

Although the invention can be implemented in software, hardware, firmware or any combination thereof, the filter design scheme proposed by the invention is preferably implemented as software in the form of program modules, functions or equivalent. In practice, the relevant steps, functions and actions of the invention are mapped into a computer program, which when being executed by the computer system effectuates the calculations associated with the determination of the phase adjustment filters. In the case of a PC-based system, the computer program used for the design of the audio filter(s) is normally encoded on a computer-readable medium such as a DVD, CD, USB flash drive, or similar structure for distribution to a user/operator, who then may load the program into his/her computer system for subsequent execution. The software may even be downloaded from a remote server via the Internet.

A filter design program implementing a filter design algorithm according to the invention, possibly together with other relevant program modules, may be stored in a peripheral memory and loaded into a system memory for execution by a processor. Given the relevant input data, such as sound measurements and/or a model representation and other optional configurations, the filter design program determines or calculates the filter parameters of the phase adjustment filter(s).

The determined filter parameters are then normally transferred from the system memory via an I/O interface to a digital filter or filter system.

Instead of transferring the calculated filter parameters directly to a filter system, the filter parameters may be stored on a peripheral memory card or memory disk for later distribution to a filter system, which may or may not be remotely located from the filter design system. The calculated filter parameters may also be downloaded from a remote location, e.g. via the Internet.

In order to enable measurements of sound produced by the audio equipment under consideration, any conventional microphone unit(s) or similar audio recording equipment may be connected to the computer system. Measurements may also be used to evaluate the performance of the combined system of phase adjustment filters and audio equipment. If the operator is not satisfied with the resulting design, he may initiate a new optimization of the filters based on a modified set of design parameters.

Furthermore, the filter design system typically has a user interface for allowing user-interaction with the filter designer. Several different user-interaction scenarios are possible. For example, the operator may decide that he/she wants to use a specific, customized set of design parameters in the calculation of the filter parameters of the filters. The filter designer then defines the relevant design parameters via the user interface.

Alternatively, the filter design is performed more or less autonomously with no or only marginal user participation.

In a particular example, the determination of the filters and the actual implementation of the filters may both be performed in one and the same computer system. This generally means that the filter design program and the filtering program are implemented and executed on the same DSP or microprocessor system.

It should also be understood that the filtering may be performed separate from the distribution of the sound signal to the actual place of reproduction. The processed signal generated by the phase adjustment filter(s) does not necessarily have to be distributed immediately to and in direct connection with the sound generating system, but may be recorded on a separate medium for later distribution to the sound generating system. The digital audio signal could then represent, for example, recorded music that has been adjusted to a particular audio equipment and listening environment. It can also be a processed audio file stored on an Internet server for allowing subsequent downloading or streaming of the file to a remote location over the Internet.

According to an aspect of the proposed technology, there is thus provided a phase adjustment filter, or a pair of phase adjustment filters, determined by using the method described herein.

There is also provided an audio system comprising a sound generating system having at least two audio reproduction channels $C_1$ and $C_2$, where each of said audio reproduction channels $C_1$ and $C_2$ has an input signal and at least one loudspeaker. The audio system further comprises phase adjustment filters $F_1(f)$ and $F_2(f)$ applied, respectively, to said audio reproduction channels $C_1$ and $C_2$, wherein the phase adjustment filters are determined by using the method described herein.

According to another aspect of the proposed technology, there is provided a digital audio signal generated and/or processed by a phase adjustment filter determined by using the method described herein.

In a particular embodiment, there is provided a computer program for determining, when executed by a computer, phase adjustment filters for an associated sound generating system comprising at least two audio reproduction channels $C_1$ and $C_2$, where each of said audio reproduction channels $C_1$ and $C_2$ has an input signal and at least one loudspeaker located in a listening environment, wherein said computer program comprises instructions, which when executed by said computer, cause said computer to:

estimate, for each of said audio reproduction channels $C_1$ and $C_2$, an acoustic transfer function at each of $M \geq 1$ spatial positions in said listening environment, based on sound measurements at said spatial positions; and determine, based on said acoustic transfer functions, phase adjustment filters $F_1(f)$ and $F_2(f)$ to be applied, respectively, to said audio reproduction channels $C_1$ and $C_2$, to reduce the IDP between said audio reproduction channels $C_1$ and $C_2$ in p listener positions.

The proposed technology also provides a carrier comprising the computer program, wherein the carrier is one of an electronic signal, an optical signal, an electromagnetic signal, a magnetic signal, an electric signal, a radio signal, a microwave signal, or a computer-readable storage medium.

By way of example, the software or computer program 125; 135 may be realized as a computer program product, which is normally carried or stored on a computer-readable medium 120; 130, in particular a non-volatile medium. The computer-readable medium may include one or more removable or non-removable memory devices including, but not limited to a Read-Only Memory (ROM), a Random Access Memory (RAM), a Compact Disc (CD), a Digital Versatile Disc (DVD), a Blu-ray disc, a Universal Serial Bus (USB) memory, a Hard Disk Drive (HDD) storage device, a flash memory, a magnetic tape, or any other conventional memory device. The computer program may thus be loaded into the operating memory of a computer or equivalent processing device for execution by the processing circuitry thereof.

The flow diagram or diagrams presented herein may be regarded as a computer flow diagram or diagrams, when performed by one or more processors. A corresponding apparatus may be defined as a group of function modules, where each step performed by the processor corresponds to a function module. In this case, the function modules are implemented as a computer program running on the processor.

The computer program residing in memory may thus be organized as appropriate function modules configured to perform, when executed by the processor, at least part of the steps and/or tasks described herein.

Figure 18:
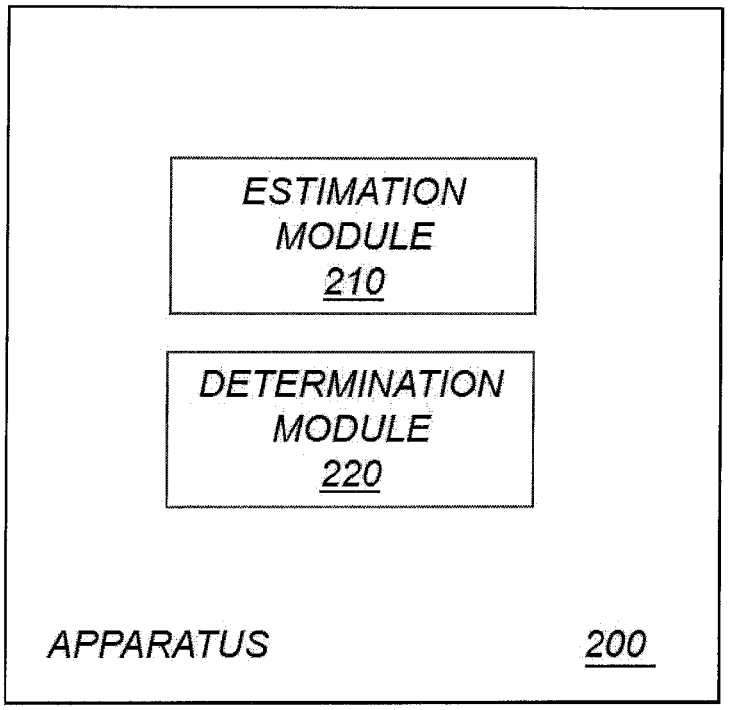
FIG. 18 is a schematic diagram illustrating an example of an apparatus for determining phase adjustment filters for an associated sound generating system.

FIG. 18 is a schematic diagram illustrating an example of an apparatus 200 for determining phase adjustment filters for an associated sound generating system comprising at least two audio reproduction channels $C_1$ and $C_2$, where each of said audio reproduction channels $C_1$ and $C_2$ has an input signal and at least one loudspeaker located in a listening environment.

The apparatus 200 comprises an estimation module 210 for estimating, for each of said audio reproduction channels $C_1$ and $C_2$, an acoustic transfer function at each of $M \geq 1$ spatial positions in said listening environment, based on sound measurements at said spatial positions. The apparatus also comprises a determination module 220 for determining, based on said acoustic transfer functions, phase adjustment filters $F_1(f)$ and $F_2(f)$ to be applied, respectively, to said audio reproduction channels $C_1$ and $C_2$, to reduce the IDP between said audio reproduction channels $C_1$ and $C_2$ in p listener positions.

Alternatively it is possible to realize the module(s) in FIG. 18 predominantly by hardware modules, or alternatively by hardware, with suitable interconnections between relevant modules. Particular examples include one or more suitably configured digital signal processors and other known electronic circuits, e.g. discrete logic gates interconnected to perform a specialized function, and/or Application Specific Integrated Circuits (ASICs) as previously mentioned. Other examples of usable hardware include input/output (I/O) circuitry and/or circuitry for receiving and/or sending signals. The extent of software versus hardware is purely implementation selection.

The embodiments described above are merely given as examples, and it should be understood that the proposed technology is not limited thereto. It will be understood by those skilled in the art that various modifications, combinations and changes may be made to the embodiments without departing from the present scope as defined by the appended claims. In particular, different part solutions in the different embodiments can be combined in other configurations, where technically possible.

REFERENCES

[1] J. Blauert. *Spatial hearing: The psychophysics of human sound localization*. MIT Press, Cambridge, Mass., 2nd edition, 1996.

[2] B. A. Cook and M. J. Smithers. Stereophonic sound imaging. US Patent Application 2009/0304213 A1, December 2009.

[3] B. Crockett, M. J. Smithers, and E. Benjamin. Next generation automotive research and technologies. Presented at *AES 120th Convention, Paris*. Preprint 6649. Audio Engineering Society, May 2006.

[4] H. Kihara. Binaural correlation coefficient correcting apparatus. U.S. Pat. No. 4,817,162, March 1989.

[5] M. J. Smithers. Improved stereo imaging in automobiles. Presented at *AES 123rd Convention, New York*. Preprint 7223. Audio Engineering Society, October 2007.

The invention claimed is:

1. A method for determining phase adjustment filters for an associated sound generating system comprising at least two audio reproduction channels, where each of said audio reproduction channels has an input signal and at least one loudspeaker located in a listening environment, wherein said method comprises:

estimating (S1), for each of said audio reproduction channels, an acoustic transfer function at each of $M \geq 1$ spatial positions in said listening environment, based on sound measurements at said spatial positions; and determining (S2), based on said acoustic transfer functions, phase adjustment filters ($F_1(f)$ and $F_2(f)$) to be applied, respectively, to said audio reproduction channels, to reduce the inter-loudspeaker differential phase (IDP) between said audio reproduction channels in p listener positions, wherein said step (S2) of determining phase adjustment filters ($F_1(f)$ and $F_2(f)$) comprises:

determining p IDP functions $\phi_1(f)$, $\phi_2(f)$, . . . , $\phi_p(f)$ between said audio reproduction channels, in a frequency interval $f_1 \leq f \leq f_2$, based on information from said acoustic transfer functions at said M spatial positions;

determining an aggregated IDP function $\overline{\phi}(f)$ based on said p IDP functions $\phi_1(f)$, $\phi_2(f)$, . . . , $\phi_p(f)$; and computing said phase adjustment filters ($F_1(f)$ and $F_2(f)$) based on said aggregated IDP function.

2. The method of claim 1, wherein said step of computing said phase adjustment filters ($F_1(f)$ and $F_2(f)$) based on said aggregated IDP function comprises:

determining phase adjustment functions, $\psi_a$) and $\psi_2(f)$ based on said aggregated IDP function $\overline{\phi}(f)$; and computing said phase adjustment filters ($F_1(f)$ and $F_2(f)$) based on said phase adjustment functions, $\psi_1(f)$ and $\psi_2(f)$.

3. The method of claim 1, wherein the aggregated IDP function is an average IDP function.

4. A method for performing phase adjustments to at least two audio reproduction channels where each of said audio reproduction channels has an input signal and at least one loudspeaker located in a listening environment, wherein said method comprises applying digital filters ($F_1(f)$ and $F_2(f)$) on the input signals of said audio reproduction channels, respectively, to reduce the IDP between said audio reproduction channels in p listener positions in said listening environment, wherein said digital filters are determined by the method of claim 1.

5. The method of claim 4, wherein said digital filters are performing said phase adjustments even when the IDP is smaller than 90 degrees.

6. The method of claim 4, wherein said IDP is an aggregated IDP of a number of IDPs between said audio reproduction channels, in a frequency interval $f_1 \leq f \leq f_2$, each of which being determined based on information from said acoustic transfer functions at said M spatial positions.

7. The method of claim 6, wherein said aggregated IDP is an average IDP.

8. An audio filter system for performing phase adjustments to at least two audio reproduction channels where each of said audio reproduction channels has an input signal and at least one loudspeaker located in a listening environment, wherein said system is configured to apply digital filters ($F_1(f)$ and $F_2(f)$) on the input signals of said audio reproduction channels, respectively, to reduce the IDP between said audio reproduction channels in p listener positions in said listening environment, wherein said digital filters are determined by the method of claim 1.

9. A phase adjustment filter ($F_1(f)/F_2(f)$) determined by using the method of claim 1.

10. An audio system comprising a sound generating system having at least two audio reproduction channels, where each of said audio reproduction channels has an input signal and at least one loudspeaker, wherein said audio system further comprises phase adjustment filters ($F_1(f)$ and $F_2(f)$) applied, respectively, to said audio reproduction channels, and wherein said phase adjustment filters are determined by using the method of claim 1.

11. A digital audio signal generated by a phase adjustment filter ($F_1(f)/F_2(f)$) determined by using the method of claim 1.

12. The method of claim 2, wherein the phase adjustment functions $\psi_1(f)$ and $\psi_2(f)$ are monotonically increasing or decreasing functions of frequency.

13. The method of claim 2, wherein the aggregated IDP function is an average IDP function.

14. A method for performing phase adjustments to at least two audio reproduction channels, where each of said audio reproduction channels has an input signal and at least one loudspeaker located in a listening environment, wherein said method comprises applying digital filters ($F_1(f)$ and $F_2(f)$) on the input signals of said audio reproduction channels respectively, to reduce the IDP between said audio reproduction channels in p listener positions in said listening environment, wherein said digital filters are determined by the method of claim 2.

15. A method for performing phase adjustments to at least two audio reproduction channels, where each of said audio reproduction channels has an input signal and at least one loudspeaker located in a listening environment, wherein said method comprises applying digital filters ($F_1(f)$ and $F_2(f)$) on the input signals of said audio reproduction channels respectively, to reduce the IDP between said audio reproduction channels in p listener positions in said listening environment, wherein said digital filters are determined by the method of claim 3.

16. A system (100; 200) for determining phase adjustment filters for an associated sound generating system comprising at least two audio reproduction channels, where each of said audio reproduction channels has an input signal and at least one loudspeaker located in a listening environment, wherein said system (100; 200) is configured to estimate, for each of said audio reproduction channels, an acoustic transfer function at each of $M \geq 1$ spatial positions in said listening environment, based on sound measurements at said spatial positions; and wherein said system (100; 200) is configured to determine, based on said acoustic transfer functions, phase adjustment filters ($F_1(f)$ and $F_2(f)$) to be applied, respectively, to said audio reproduction channels, to reduce the IDP between said audio reproduction channels in p listener positions, wherein said system (100; 200) is configured to determine p IDP functions $\phi_1(f), \phi_2(f), \ldots, \phi_p(f)$ between said audio reproduction channels, in a frequency interval $f_1 \leq f \leq f_2$, based on information from said acoustic transfer functions at said M spatial positions, wherein said system (100; 200) is configured to determine an aggregated IDP function $\overline{\phi}(f)$ based on said p IDP functions $\phi_1(f), \phi_2(f), \ldots, \phi_p(f)$, and wherein said system (100; 200) is configured to compute said phase adjustment filters ($F_1(f)$ and $F_2(f)$) based on said aggregated IDP function.

17. The system of claim 16, wherein said system (100; 200) is configured to determine phase adjustment functions $\psi_1(f)$ and $\psi_2(f)$, based on said aggregated IDP function $\overline{\phi}(f)$; and wherein said system (100; 200) is configured to compute said phase adjustment filters ($F_1(f)$ and $F_2(f)$) based on said phase adjustment functions $\psi_1(f)$ and $\psi_2(f)$.

18. A computer program (125; 135) for determining, when executed by a computer (100), phase adjustment filters for an associated sound generating system comprising at least two audio reproduction channels, where each of said audio reproduction channels has an input signal and at least one loudspeaker located in a listening environment, wherein said computer program (125; 135) comprises instructions, which when executed by said computer (100), cause said computer to:

estimate, for each of said audio reproduction channels, an acoustic transfer function at each of $M \geq 1$ spatial positions in said listening environment, based on sound measurements at said spatial positions; and determine, based on said acoustic transfer functions, phase adjustment filters ($F_1(f)$ and $F_2(f)$) to be applied, respectively, to said audio reproduction channels, to reduce the IDP between said audio reproduction channels in p listener positions by:

determining p IDP functions $\phi_1(f), \phi_2(f), \ldots, \phi_p(f)$ between said audio reproduction channels, in a frequency interval $f_1 \leq f \leq f_2$, based on information from said acoustic transfer functions at said M spatial positions;

determining an aggregated IDP function $\overline{\phi}(f)$ based on said p IDP functions $\phi_1(f), \phi_2(f), \ldots, \phi_p(f)$; and computing said phase adjustment filters ($F_1(f)$ and $F_2(f)$) based on said aggregated IDP function.

19. A computer-program product comprising a computer-readable medium (120; 130) having stored thereon a computer program (125; 135) of claim 18.

20. An apparatus (200) for determining phase adjustment filters for an associated sound generating system comprising at least two audio reproduction channels, where each of said audio reproduction channels has an input signal and at least one loudspeaker located in a listening environment, wherein said apparatus comprises:

an estimation module (210) for estimating, for each of said audio reproduction channels, an acoustic transfer function at each of $M \geq 1$ spatial positions in said listening environment, based on sound measurements at said spatial positions; and a determination module (220) for determining, based on said acoustic transfer functions, phase adjustment filters ($F_1(f)$ and $F_2(f)$) to be applied, respectively, to said audio reproduction channels, to reduce the IDP between said audio reproduction channels in p listener positions by:

determining p IDP functions $\phi_1(f), \phi_2(f), \ldots, \phi_p(f)$ between said audio reproduction channels, in a frequency interval $f_1 \leq f \leq f_2$, based on information from said acoustic transfer functions at said M spatial positions;

determining an aggregated IDP function $\overline{\phi}(f)$ based on said p IDP functions $\phi_1(f), \phi_2(f), \ldots, \phi_p(f)$; and computing said phase adjustment filters ($F_1(f)$ and $F_2(f)$) based on said aggregated IDP function.

* * * * *